United States Patent [19]

Derby et al.

[11] Patent Number: 4,909,410

[45] Date of Patent: Mar. 20, 1990

[54] PROTECTIVE COVER FOR BULK CONTAINER

[75] Inventors: Norwin C. Derby, Sherman; Ernest J. Benson, Dallas, both of Tex.

[73] Assignee: Better Agricultural Goals, Inc., Dallas, Tex.

[21] Appl. No.: 356,349

[22] Filed: May 24, 1989

Related U.S. Application Data

[62] Division of Ser. No. 245,629, Sep. 19, 1988.

[51] Int. Cl.[4] ..... B65D 25/36

[52] U.S. Cl. ..... 220/402; 53/449; 220/449; 220/461; 383/6; 383/119; 493/99; 493/100

[58] Field of Search ..... 53/449; 220/400, 402, 220/403, 449, 460, 461; 383/6, 16, 20, 24, 104, 119; 493/99, 100, 118

[56] References Cited

U.S. PATENT DOCUMENTS

| | | | |
|---|---|---|---|
| 1,662,018 | 3/1928 | Orman | 220/400 |
| 1,719,868 | 7/1929 | Beverly | 220/449 |
| 1,797,681 | 3/1931 | Ferguson | 220/400 |
| 2,403,836 | 7/1946 | Wagner | 220/461 |
| 2,437,058 | 3/1948 | Waters | 220/460 |
| 3,225,983 | 12/1965 | Majka | 220/460 |
| 3,242,960 | 3/1966 | Schwartzman | 220/403 |
| 3,540,615 | 11/1970 | Paine | 220/461 |

*Primary Examiner*—Jimmy G. Foster
*Attorney, Agent, or Firm*—Michael A. ONeil

[57] ABSTRACT

A method and apparatus for providing a protective cover for a flexible semi-bulk container to protect the container from contamination during filling, handling and storing. The protective covering forms no permanent bond and is strippable from the outside of the container when the container is ready for marketing and display.

26 Claims, 1 Drawing Sheet

PROTECTIVE COVER FOR BULK CONTAINER

This is a division of application Ser. No. 245,629 filed Sept. 19, 1988.

The present invention relates to improvements in flexible containers for use in transporting, storage and handling of flowable materials and, in particular, relates to a protective cover for a flexible semi-bulk container which encases the container in whole or in part to protect it from becoming contaminated during filling, handling and storing of said container.

BACKGROUND OF THE INVENTION

Flowable materials, in particular, the dry particulate materials, present unique problems in their storage, transportation, dispensing and handling. These materials, for example, include chemicals, fertilizers, minerals, food stuffs, agricultural products and the like.

The bags or containers for these materials are usually flexible so that they can be easily handled, have large capacities and provide top filling and bottom discharge. The bags may be made in several layers to provide the strength that is needed to handle large quantities of product. The bags may be such as those disclosed in U.S. Pat. Nos. 3,962,959 and 4,113,146. Of course, smaller sizes of such bags could also be used.

During the filling of such bags with product, because the product is flowable, a great deal of dust is generated which settles on the outside of the bag. Further, during the handling and storage of the bags, they often come in contact with contaminants such as dirt, grease, oil and other substances which when contacted, are deposited on the bag. Such contaminants are not only unsightly, thus rendering the bag unacceptable for a marketing display, but also, in many cases, the product within the bag is a food product which must be protected from contaminants.

The present invention overcomes these disadvantages by providing a protective cover for a flexible semi-bulk bag or container which protects the container from being contaminated with extraneous material during filling, handling and storing.

In the present invention, the protective covering forms no permanent bond with the container which it covers and may be stripped from the outside of the container when the container is ready for marketing and display, thus, presenting a clean container free from contaminants and acceptable to be displayed.

In one embodiment of the invention, the container is coated with a material such as polyethylene which forms no permanent bond to the container and which can be easily stripped from the outside of the container when it is ready for marketing and display.

In still another embodiment of the invention, removable skirts of plastic film or paper or sewn into the top seam of the sack to hang down and cover the sides.

In yet another embodiment of the invention, the protective cover is formed of either plastic film or paper with an opening in the top for alignment with the filler opening of the container and with an opening at each top corner for the lifting straps of the container so that the container, when full, can be lifted by the straps extending through the openings in each corner.

Still another embodiment of the protective cover is in the form of a shaped liner larger than the container and which receives the empty container. Lift straps of the container are inserted through corner slots which have extensions or ears formed therefrom so that once the lift straps are inserted through the extensions, they can be tied off to make a dust-free or tight corner. In addition, the shaped liner has a cover spout through which the fill spout of the container can be accessed so that the container can be filled. The fill sack spout can be closed first and then the cover spout can be tied off to protect contaminants from entering the top of the covering to reach the container. Further, the shaped liner can be made long enough to close or tie off the bottom after the container is filled.

SUMMARY OF THE INVENTION

Thus, the present invention relates to a protective covering for a flexible semi-bulk container having a top panel with outer edges and a fill orifice, side panels joined together at their side edges, top edges on the side panels join to corresponding outer edges of the top panel and a bottom panel attached to the bottom edges of the side panels to form said container, the bottom panel having a discharge orifice, the protective cover comprising a protective cover material removably coated on the outside of the container and which forms no permanent bond to protect the container from being contaminated during filling, handling and storing, the material being strippable from the outside of the container when the container is ready for marketing and display.

The invention also relates to a method of protecting a flexible semi-bulk container from contamination, the container having a top panel with outer edges and a fill orifice, side panels joined together at their side edges, top edges on the side panels joined to corresponding outer edges of the top panel and a bottom panel attached to the bottom edges of the side panels to form such container, the bottom panel having a discharge orifice, the method of providing the protective cover comprising the steps of removably coating a protective cover material on the outside of the container panel and which forms no permanent bond, to protect the container from being contaminated during filling, handling and storing, the material being strippable from the outside of the container when the container is ready for marketing and display.

BRIEF DESCRIPTION OF THE DRAWINGS

These and other objects of the present invention will be more readily understood in conjunction with the following specification and drawings in which.

DETAILED DESCRIPTION OF THE DRAWINGS

Because of the nature of products that are handled, flexible semi-bulk containers often get dirty during filling with the product and during storage. When it is time to market or display the bags or containers with the product, the contamination or dirt often makes the display of the container unacceptable. The present invention reduces such contamination by providing a protective cover for containers which may be removed from the container when it is ready for marketing and display.

Figure 1:
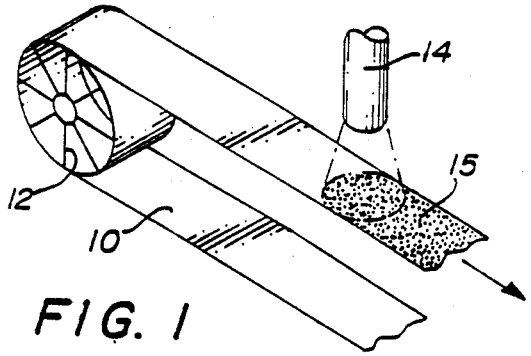
FIG. 1 is a schematic representation of a method by which a material such as polypropylene, which is utilized to make a container, can be coated with a material such as polyethylene prior to the use of the material in manufacturing a bag or container to protect the bag from contamination until such time as it ready for marketing or display.
Figure 2:
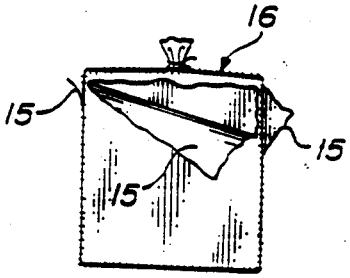
FIG. 2 is a side view of a completed bag filled with a product and from which the polyethylene is being stripped from the container to make it presentable for display.

One approach to solving this problem is to form such container with a material that has on it a removable coating which forms no permanent bond and which protects the material from becoming contaminated but which can be stripped from the outside of the material when needed to display the material. Such material can be formed as illustrated in FIG. 1 where the material 10, such as polypropylene, in continuous sheet form, passes over drive wheel 12 and under a unit 14 which sprays a material such as polyethylene on the surface of the polypropylene thereby coating that surface with a material, which when dry, can be readily stripped from the polypropylene 10 when and as desired. By constructing a product container from the material formed with the process shown in FIG. 1, and by constructing the container such that the polyethylene coating is on the outside of the container, the polyethylene coating will protect the container from becoming contaminated during filling, handling and storing. Still, because the protective polyethylene coating forms no permanent bond to the polypropylene, it can be stripped from the outside of the container when the container is ready for marketing and display. Thus, as shown in FIG. 2, a container bag 16 is ready for marketing and display and the polyethylene coating 15 is illustrated as being separated from the sides of the container 16. Thus, during the filling, handling and storing of the container 16, the polyethylene coating 15 protects the container from any kind of contamination including dust and dirt and yet when the polyethylene coating is removed, the inner polypropylene container 16 is clean and can then be displayed.

Figure 3:
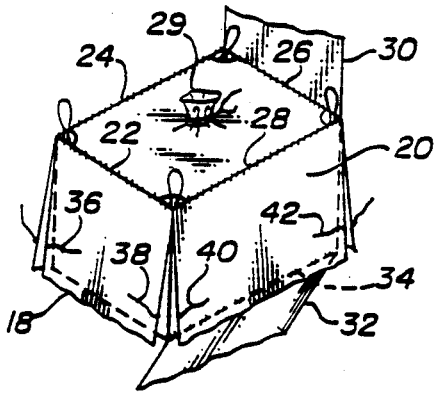
FIG. 3 is a perspective view of a container illustrating a second embodiment of the invention in which skirts of film or paper sewn into the top and bottom seams are used to cover the sides, the top and the bottom of the container to protect it from contamination and which are removable at the appropriate time to prepare the container for display.

FIG. 3 is a representation of an alternate embodiment of the present invention in which side skirts 18 and 20 of plastic film or paper are sewn into the top seams 22, 24, 26 and 28 and which hang down to cover the sides of the container. Another sheet of film or paper 30 can be sewn into one of the top seams such as seam 26 and used to cover the top of the bag including spout 29 which would be closed in any well known means as by ties (not shown). In like manner, a sheet 32 can be sewn into the bottom seam 34 to cover the bottom of the container. The skirts of film or paper can be held in place in any well known manner such as with ties 36, 38, 40 and 42. When the container is ready for display, the ties 36, 38 40 and 42 can be released and the sheets such as 18, 20, 30 and 32 can be torn from the seams and the clean container displayed.

Figure 4:
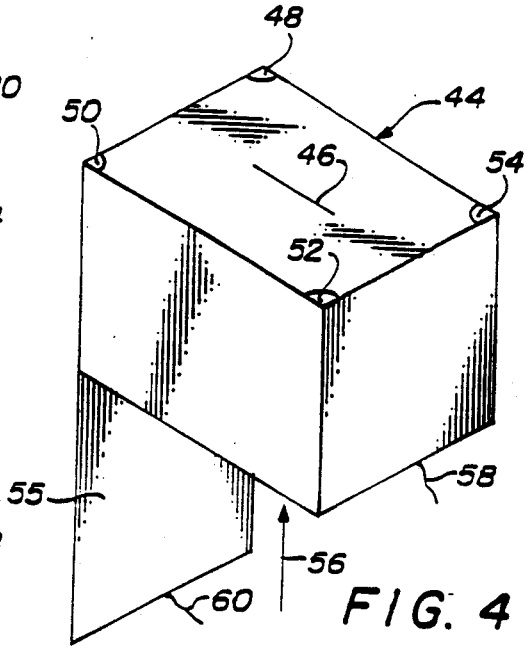
FIG. 4 illustrates a third embodiment of the invention which is a secondary cover formed of plastic film or paper having an opening in the top to reach the filling spout of the container and an aperture at each corner so that the lift straps of the container can extend through the apertures.

FIG. 4 illustrates a secondary cover 44 formed of plastic film or paper which has a center aperture 46 through which the filling spout of the container (not shown) can be accessed and also has openings 48, 50, 52 and 54 at each of the upper corners through which the lift straps of the container can project. The container is inserted into the cover from the bottom in the direction of arrow 56 after which a bottom panel 58 is closed to cover the bottom and secured by any well known means such as tie straps 58 and 60. Thus, during filling, handling and storing operations, the container is protected by the cover 44 from contamination such as dust and dirt. When the container is ready for display, the cover 44 is removed from the container and the clean container can then be displayed.

Figure 5:
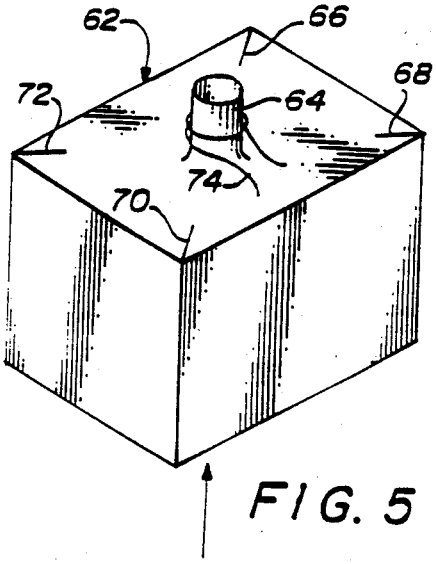
FIG. 5 illustrates a fourth embodiment of the invention in which a shaped liner made of plastic film or paper has an opening in the top for the filling spout of the container and apertures at each corner through which the lift straps can project.

FIG. 5 illustrates the preferred embodiment of the protective cover which is a shaped liner 62 of either plastic or paper into which the container is inserted while empty. The lifting straps of the container project through openings 66, 68, 70 and 72 in the corners of the shaped liner 62. The filling spout of the container projects through opening 64 in the top of shaped liner 62. When the container has been filled, the container spout can be closed in a normal fashion and then the cover spout 64 of the liner 62 can be tied off in any well known manner such as with tie string 74. A bottom panel can be placed on the shaped liner 62 shown in FIG. 4 if desired. The protective cover 62 can, of course, be removed at any time but will protect the container inside from contamination until such time as it is removed.

Figure 6:
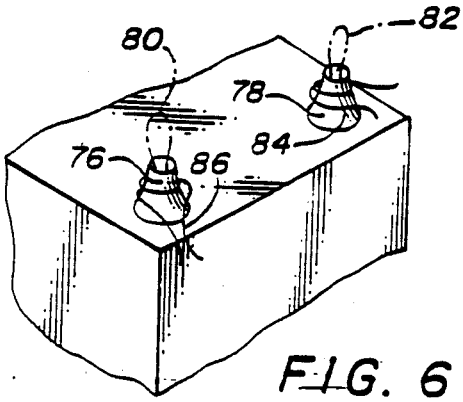
FIG. 6 is a partial view of a shaped liner such as that illustrated in FIG. 5 but which has tubular extensions at the corners through which the lift straps project and which can be tied off to further reduce contamination of the container inside the liner.

If it is desired to make the shaped liner 62 further contamination proof, extensions such as 76 and 78 can be formed around the openings 66, 68, 70 and 72 of FIG. 5 through which the container straps 80 and 82, shown in dotted lines, extend as shown in FIG. 6. Any well known means such as tie strings 84 and 86 can then be used to close off extensions 76 and 78 to prevent contamination from entering through the opening 66, 68, 70 and 72.

If it is desired to use the cover on liner 62 to maintain the container in a sanitary condition, it can be extended in length and bottom closed after the container is inserted. The liner 62 will then stay in place until the container is ready to enter a clean or sanitary area. The liner 62 would then be stripped leaving the clean container. This invention is applicable for food products, pharmaceuticals, super clean resins, and the like, for example.

Thus, there has been disclosed a protective cover for a flexible semi-bulk container which has no permanent bond with the container and which is readily removable thereby protecting the container from becoming contaminated during filling, handling and storing, but which may be removed from the outside of the container when the container is ready for marketing and display.

Although the invention has been described and illustrated in detail, it is to be understood that the same is by way of illustration and example only and is not to be taken by way of limitation. The spirit and scope of this invention are to be limited only by the terms of the appended claims.

We claim:

1. A protective cover for a flexible semi-bulk container having a top panel with a fill opening, side panels and a bottom panel, all of said panels being joined together at their respective adjoining edge seams to form said flexible, semi-bulk container, said cover comprising:

a sheet of protective material removably sewn into the top edge seam of each side panel and having a sufficient width and length to cover each side panel;

means for removably attaching the adjoining edges of the protective sheets covering the side panels to each other after said container has been filled to protect the sides of the container from contamination during filling, handling and storing;

a sheet of protective material having one edge removably sewn into one of the top panel edge seams and having an opening for alignment with said fill opening and being of sufficient width and length to cover said top panel;

means for removably attaching at least the edge opposite said one sewn edge on said top protective sheet to the opposite edge seam after said container has been filled to protect said container top from contamination during filling, handling and storing; and said protective material being strippable from said outside of said container when said container is ready for marketing and display.

2. A protective cover as in claim 1 further including:

a sheet of protective material having one edge removably sewn into one of the bottom panel edge seams and having a sufficient width and length to cover said bottom panel; and means for removably attaching at least the edge of said protective material opposite said one sewn edge on said bottom protective sheet to the opposite edge seam to protect said container bottom from contamination during filling, handling and storing.

3. A protective cover as in claim 2 wherein said protective material is formed of polyethylene.

4. A protective cover as in claim 2 wherein said protective material is paper.

5. A protective cover for a flexible, semi-bulk container having a top panel with a fill opening, side panels and a bottom panel, all of said panels being joined together at their respective adjoining edge seams to form said container, and a lift strap attached to and extending above each of at least two corners of said top panel for lifting said container when filled, said cover comprising:

a protective material forming a bag larger than said container and having a top panel with an opening for alignment with said container fill opening to enable a container inside said cover to be filled and corner openings for enabling lift straps of a container inside said cover to project through and extend above said openings for lifting access; and side panels joined at the top edges to corresponding edges of said top panel and at their respective side edges to each other to form a protective cover into which said container may be inserted and protected during filling, handling and storing, said protective material being removable from the outside of the container when the container is ready for marketing and display.

6. A protective cover as in claim 5 wherein said protective material is formed of polyethylene.

7. A protective cover as in claim 5 wherein said protective material is paper.

8. A protective cover for a flexible, semi-bulk container having a top panel with a fill spout for receiving a product, side panels and a bottom panel, all of said panels being joined together at their respective adjoining edge seams to form said container, and lift strips attached to and extending above at least each of two corners of said top panel for lifting said container when filled, said cover comprising:

a protective material forming a shaped cover larger than said container and having a top wall with a sealable opening for alignment with and receiving said container fill spout to enable a container inside said shaped cover to be filled with said product and corner openings for enabling lift straps of a container within said cover to project through and extend above said corner openings to enable lifting of said container when filled with product;

side walls joined at their respective top edges to corresponding edges of said top wall and at their respective side edges to each other to form a protective cover into which said container may be inserted, said side walls being of sufficient length to extend below said container; and means for sealing said protective cover top opening so as to protect said container during filling, handling and storing of said container, said cover being removable when said container is ready for marketing and display.

9. A protective cover as in claim 8 wherein said protective material is polyethylene.

10. A protective cover as in claim 8 wherein said protective material is paper.

11. A protective cover as in claim 8 wherein said container opening is closed through said protective cover top opening after said container has been filled.

12. A protective covering as in claim 11 further including means for closing the open bottom of the protective cover by tying off extended portions of the protective cover side walls.

13. A protective covering as in claim 12 further including:

elongated tubular portions extending upwardly from said corner openings of said protective cover for receiving said lift straps projecting therethrough; and means for sealing said elongated tubular portions about said lift straps to completely seal said container within said cover so as to protect the container from contamination during filling, handling and storage, said cover being removable when the container is to be marketed and displayed.

14. A method of protecting a flexible semi-bulk container from contamination during filling, handling and storing, said container having a top panel with a fill opening, side panels and a bottom panel, all of said panels being joined together at their respective adjoining edge seams to form said flexible, semi-bulk container, said method comprising the steps of:

sewing a sheet of removable , protective material into the top edge seam of each side panel, the sheet having a sufficient width and length to cover each side panel;

removably attaching the adjoining edges of the protective sheets covering the side panels of the container to each other after the container has been filled to protect the sides of the container from contamination during filling, handling and storing;

removably sewing one edge of a sheet of protective material into one of the top panel edge seams with a sufficient width and length to cover said top panel, said top panel having an opening for alignment with the fill opening of a container; and removably attaching at least the edge opposite said one sewn edge on said top protective sheet to the opposite edge seam after said container has been filled to protect said container top from contamination during filling, handling and storing, said protective material being strippable from the outside of the container when the container is ready for marketing and display.

15. A method as in claim 14 further including the steps of:

removably sewing one edge of a sheet of protective material into one of the bottom panel edge seams, the sheet having a sufficient width and length to cover the bottom panel; and removably attaching at least the edge of said sheet of protective material opposite said one sewn edge on said bottom protective sheet to the opposite edge seam to protect said container bottom from contamination during filling, handling and storing.

16. A method as in claim 15 further comprising the step of forming the protective material of polyethylene.

17. A method as in claim 15 further including the step of forming said protective material of paper.

18. A method of protecting a flexible, semi-bulk container from contamination during filling, handling and ring, said container having a top panel with a fill opening, side panels and a bottom panel, all of said panels being joined together at their respective adjoining edge seams to form said container, and a lift strap attached to and extending above each of at least two corners of said top panel for lifting said container when filled, said method comprising the steps of:

forming a bag of protective material larger than said container and having a top panel with an opening for alignment with said container fill opening to enable a container inside said bag to be filled and corner openings for enabling lift straps of a container inside said bag to project through and extend above said openings for lifting access; and joining the side panels at their top edges to corresponding edges of the top panel and at their respective side edges to each other to form a protective bag into which said container may be inserted and protected during filling, handling and storing, said protective material being removable from the outside of the container when the container is ready for marketing and display.

19. A method as in claim 18 further comprising the step of forming said protective material of polyethylene.

20. A method as in claim 18 further comprising the step of forming said protective material of paper.

21. A method of protecting a flexible, semi-bulk container from contamination during filling, handling and storing, said container having a top panel with a fill spout for receiving a product, side panels and a bottom panel, all of said panels being joined together at their respective adjoining edge seams to form said container, and lift straps attached to and extending above at least each of two corners of said top panel for lifting said container when filled, said method comprising the steps of:

forming a shaped cover of protective material, said cover being larger than said container and having a top wall with a sealable opening for alignment with and receiving said container fill spout to enable a container inside said shaped cover to be filled with product, and corner openings for enabling lift straps of a container within said cover to project through and extend above said corner openings for enabling lifting of the container when filled with product;

joining the side walls at their respective top edges to corresponding edges of said top wall and at their respective side edges to each other to form a protective cover into which the container may be inserted, said side walls being of sufficient length to extend below said container; and sealing said protective top opening so as to protect the container during filling, handling and storing of the container, said cover being removable when the container is ready for marketing and display.

22. A method as in claim 21 further comprising the step of forming said protective material of polyethylene.

23. A method as in claim 21 further comprising the step of forming said protective material of paper.

24. A method as in claim 21 further including tne step of closing said container opening through said protective cover top opening after said container has been filled.

25. A method as in claim 24 further including the step of closing the open bottom of said protective cover by tying off the extended portions of the protective cover side walls.

26. A method as in claim 25 further including the steps of:

extending elongated tubular portions upwardly from said corner openings of said protective cover for receiving said lift straps projecting therethrough; and sealing said elongated portions about said lift straps to completely seal said container within the cover so as to protect the container from contamination during filling, handling and storing, said cover being removable when said container is to be marketed and displayed.

* * * * *